United States Patent [19]

Goldberg

[11] Patent Number: 4,804,103

[45] Date of Patent: Feb. 14, 1989

[54] CAN SEALER

[75] Inventor: Elisabeth Goldberg, Munich, Fed. Rep. of Germany

[73] Assignee: D.S.R. Products, Woodland Hills, Calif.

[21] Appl. No.: 181,195

[22] Filed: Apr. 13, 1988

[51] Int. Cl.[4] ..... B65D 45/00

[52] U.S. Cl. ..... 220/251

[58] Field of Search ..... 220/238, 243, 247, 251

[56] References Cited

U.S. PATENT DOCUMENTS

| | | | |
|---|---|---|---|
| 2,448,838 | 9/1948 | Sohnlein | 220/251 |
| 3,727,787 | 4/1973 | Gregory | 220/243 |
| 3,982,656 | 9/1976 | Kusmierski et al. | 220/238 |
| 4,387,826 | 6/1983 | Heubl | 220/243 |

*Primary Examiner*—Donald F. Norton

*Attorney, Agent, or Firm*—Fulwider, Patton, Rieber, Lee & Utecht

[57] ABSTRACT

The can sealer apparatus includes a plate member having a skirt protruding from the bottom of the plate shaped to conform to the surface of the can lid, of a size sufficient to encompass the opening in the can lid. The plate member has a central aperture, and a post member, having at least one bevelled edge on the bottom surface of the post. The stem of a generally T-shaped member extends through the central aperture of the plate member and includes a handle for urging the bottom crosspiece of the stem toward the plate member. An elastomeric sealing member is also provided between the plate member and the crosspiece of the T-shaped member, adapted to be clamped over the top surface of the can lid while the crosspiece presses against the under surface of the can lid.

4 Claims, 2 Drawing Sheets

FIG. 3
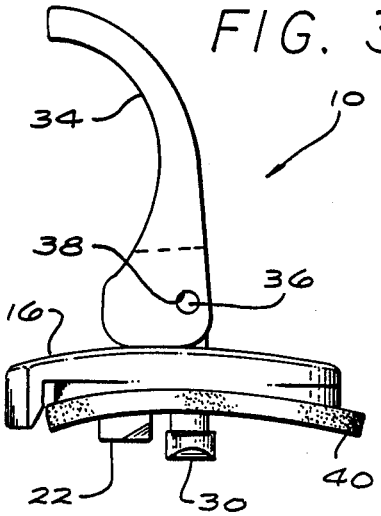
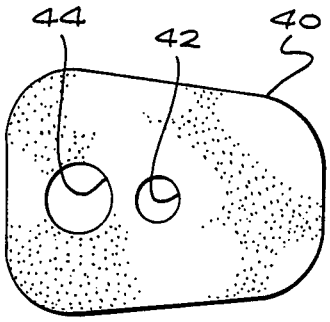
FIG. 6
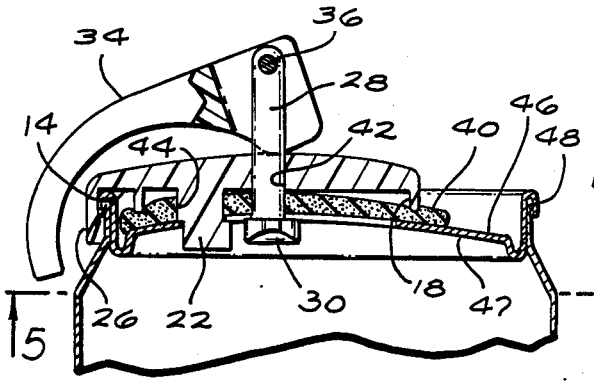
FIG. 4
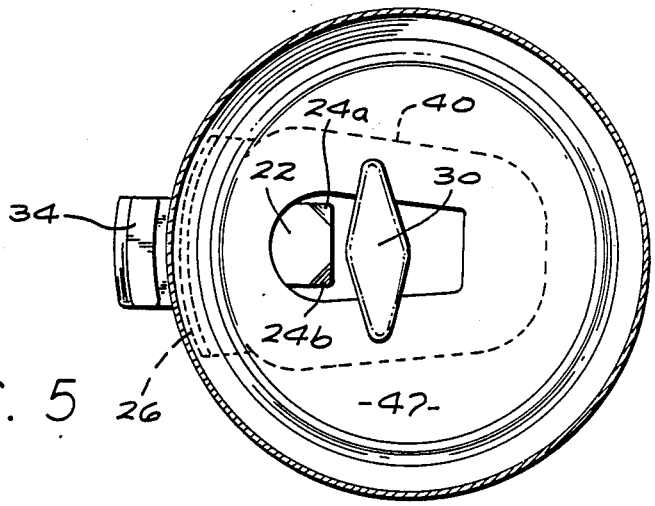
FIG. 5

CAN SEALER

BACKGROUND OF THE INVENTION

1. Field of the Invention

This invention relates generally to an apparatus for sealing an opening in a container, and more particularly relates to an apparatus for sealing an opening in a pressurized container, such as a carbonated beverage can.

2. Prior Art

Resealing of bottles for carbonated beverages to preserve carbonation once the bottle has been opened typically has been accomplished with snap-on resilient caps and expandable cork-like sealers that fit within the mouth of a bottle. Resealing the opening of a carbonated beverage can has proved less practical. Can sealers having a resilient sealing member with portions fitting into the skirt of a backup plate member and having a T-shaped member extending through the sealing and backup members is known from U.S. Pat. Nos. 3,982,656 and 3,727,787. The cross-piece of the "T" member is adapted to engage the lid of the can by moving a handle at the end of the stem of the "T" member. This type of a can sealer device in practice is difficult to apply to the can and does not satisfactorily seal can lids having retained pop-top tabs, irregularities in their surfaces, or openings other than simple oval shapes. It would therefore be desirable to provide a can sealer that would conform to a wide variety of can lid surfaces, and that would facilitate insertion of the device through a wide variety of sizes and shapes of openings. It would also be desirable to provide some means for allowing the consistent alignment and positioning of the can sealer within the opening, to help insure that the can sealer provides an adequate seal around the entirety of the opening. The present invention fulfills these needs.

SUMMARY OF THE INVENTION

Briefly, and in general terms, the present invention provides for a can sealer for sealing an opening in a generally flat can lid. The can sealer apparatus includes a plate member having a skirt protruding from the bottom of the plate shaped to conform to the surface of the can lid, of a size sufficient to encompass the opening in the can lid. The plate member has a central aperture, and a post member, having at least one bevelled edge on the bottom surface of the post. The stem of a generally T-shaped member extends through the central aperture of the plate member and includes a handle means for urging the bottom crosspiece of the stem toward the plate member. An elastomeric sealing member is also provided between the plate member and the crosspiece of the T-shaped member, adapted to overlie the top surface of the can lid while the crosspiece presses against the undersurface of the can lid. The sealing member extends beyond the periphery of the skirt of the plate member, so as to insure a wide sealing surface area. The post on the plate member additionally serves to extend the crosspiece of the T-shaped member well away from the sealing member, in preparation for insertion of the can sealer in the opening of a can lid, so that the crosspiece can readily grip the undersurface of the can lid.

More specifically, and in a presently preferred embodiment, by way of example and not necessarily by way of limitation, a can sealer apparatus according to the invention, for sealing an opening in a generally flat can cover, comprises a plate member having a skirt protruding from the bottom of the plate member shaped to generally conform to the top surface of the can lid, of a size sufficient to encompass the opening in the can lid, the plate member having a central aperture, and a post member extending from the bottom of the plate member having at least one bottom bevelled edge; an elastomeric sealing member of a size sufficient to cover the opening in the can lid and extending beyond the skirt of the plate member, and having a central aperture adapted to be aligned with the central aperture of the plate member, and having a second aperture for receiving the post of the plate member; and handle means for urging the plate member and sealing member against the upper surface of the can lid, including a stem adapted to extend through said plate member aperture and said sealing member aperture, and a crosspiece member on one end of the stem adapted to slide over the bottom surface of the post member and engage the undersurface of the can lid, to clamp the plate member and sealing member in position over the opening, to thereby seal the opening in the can lid.

In a preferred embodiment, there is also a flange extending downward from one end of the plate member adapted to fit over the outside lip of the can lid for securing the can sealer in a consistently accurate position within the opening of the can lid. It is also preferred that at the upper end of the stem, the handle means for urging the plate member and sealing member against the can lid comprises a handle movable between a first position, which allows free movement of the crosspiece to ride over the bottom surface of the post, and a second position, urging the plate member and sealing members against the can lid surface by clamping the crosspiece against the undersurface of the can lid.

Other aspects and advantages of the invention will become apparent from the following detailed description, when taken in conjunction the accompanying drawings of illustrative embodiments of the invention.

BRIEF DESCRIPTION OF THE DRAWINGS

FIG. 3 is a reduced elevational view of the can sealer showing the handle means in a first position, with the crosspiece away from the post member;

FIG. 4 is an elevational cross-sectional view of the can sealer applied to the lid of a can and with the handle means in the second, locked position;

FIG. 5 is a view taken along line 5—5 of FIG. 4; and

FIG. 6 is a top plan view of the elastomeric sealing member used in the can sealer shown in FIGS. 1–6.

DETAILED DESCRIPTION OF THE INVENTION

Figure 1:
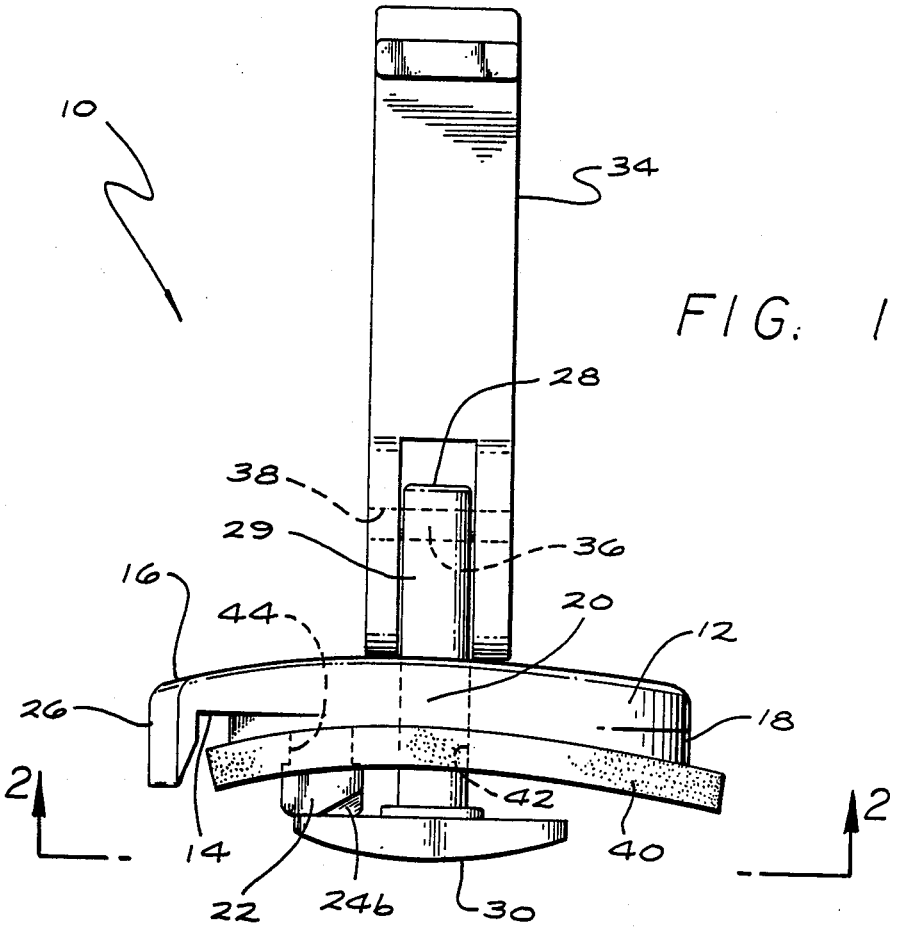
FIG. 1 is an elevational view of a can sealer embodying features of the present invention.
Figure 2:
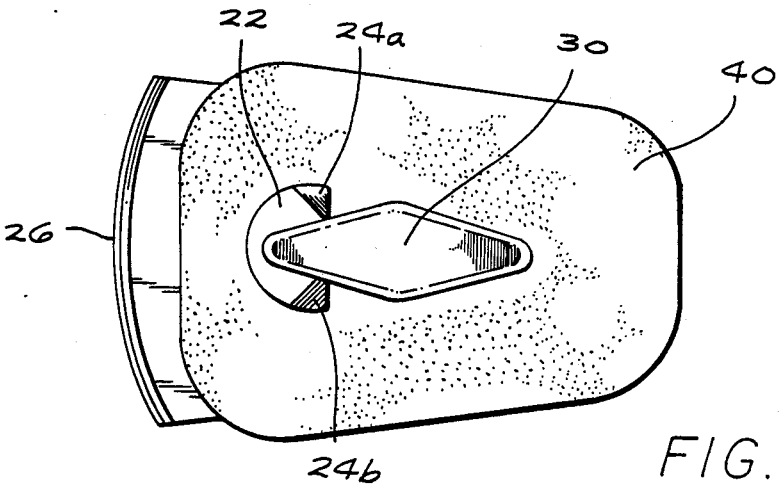
FIG. 2 is a bottom plan view of the can sealer taken along line 2—2 of FIG. 1.

As is shown in the drawings for purposes of illustration, the invention is embodied a can sealer apparatus for resealing an opening in a generally flat can lid, with a plate member and an elastomeric sealing member, and a handle means for urging the plate member and sealing member against the upper surface of the can lid about the opening. The apparatus is particularly useful for sealing pressurized carbonated beverage cans with slightly irregular but generally flat lids, and a wide variety of differently shaped can openings.

In accordance with the invention there is provided a can sealer apparatus for sealing an opening in a generally flat can lid, comprising a plate member having a top side and a bottom side, a skirt of a size sufficient to encompass the opening protruding from the bottom side of the plate member, and having a lower edge whose shape is adapted to conform to the top surface of the can lid, the plate member having a surface defining a central opening in the plate member, and a post member protruding from the bottom side of the plate member, the post member having at least one bottom bevelled edge; an elastomeric sealing member of a size sufficient to cover the opening in the can lid, and extending beyond the skirt of the plate member, the sealing member having atop side and a bottom side, the surface of the sealing member defining a central aperture adapted to be aligned with said plate member central aperture, and a secondary aperture adapted to receive the post member; and handle means for urging the plate member and sealing member against the top surface of the can lid, said handle means including a stem adapted to extend through the central aperture of the plate member and the central aperture of the sealing member, a crosspiece member on one end of the stem adapted to ride over the bevelled edge of the post member in one position, and adapted to engage the undersurface of the can lid in a second position, and the other end of the stem including means for moving the crosspiece between the crosspiece first and second positions, the means for moving having a first position in which the crosspiece may move freely to ride over the post member, and a second position urging the crosspiece member toward the plate member and sealing member, whereby the plate member and sealing member can be securely clamped to the can lid to seal the opening.

As is shown in the drawings, the can sealer 10 includes a rigid plate member 12, preferably formed of hard plastic. The plate member has a top side 16 and bottom side 14 having an annular skirt 18 protruding downwardly therefrom. Approximately in the center of the plate member there is an aperture 20. At one end of the plate member an accurate flange 26 is formed, projecting downwardly at a position spaced radially outwardly from the skirt. In between the central aperture and the flange, a post member 22 protrudes downwardly, having an enlarged head portion with bevelled edges **24*a* and 24*b*** on two of the bottom corners thereof. Although in the preferred embodiment two corners are bevelled, the post member may alternatively have a bevelled edge all around the head portion, or as will be apparent later, only one bevelled corner.

A T-shaped stem member 28 having an enlongated cylindrical stem 29 and a bottom diamond-shaped crosspiece 30 is adapted to fit through the central aperture of the plate member, with the crosspiece on the bottom of the stem, and a curved handle 34 mounted on the other end of the stem. A cross pin 36 extends through the end of the stem, and is journaled in apertures 38 formed in ears 37 on opposite sides on an axial slot 39 in the handle to allow unobstructed rotational movement of the handle about the end of the stem.

A relatively thick and flexible elastomeric sealing member 40 is also provided, to be positioned on the bottom side of the plate member. The sealing member has a central aperture 42 for receiving the stem of the T-shaped member, and a secondary aperture 44, smaller than the diameter of the head portion of the post member, for receiving the post member, which then holds the sealing member in position against the plate member. The sealing member is preferably made of an elastomeric material which is most preferably a rubber, such as butyl rubber, which may be compressed to conform to irregularities in the upper surface 46 of the can lid. The sealing member is also preferably larger in planar dimensions than the skirt, in order to provide a large sealing surface beneath the skirt and extending out beyond the skirt, the skirt providing a line of compressive force about the edge of the sealing member.

With reference to FIGS. 3 and 4, the handle journaled at the end of the stem has a cam portion 43 shaped so that when the handle is in first upright position as shown in FIG. 3, the stem extends a substantial distance through the plate member and the crosspiece of the stem is free to rotate and move axially with respect to the sealing member and the plate member. By rotation of the handle member, one end of the crosspiece rides up over one of the bevelled corners of the post member to force the stem member fully downward, as is illustrated in FIG. 1. The can sealer crosspiece can then be inserted through an opening in a can lid, and rotated to a lateral position to engage the undersurface 47 of the can lid. The positioning of the crosspiece sufficiently downward to reach under the undersurface of the can lid is facilitated by the downward displacement of the stem and crosspiece by the post member. Once the crosspiece is in a lateral downward position to engage the under surface of the can lid, the handle member can be placed in a second downward position, as is shown in FIG. 4, pulling the stem back through the plate member and urging the crosspiece, the plate member and sealing member together, to clamp the can sealer in sealing relationship over the opening in the can lid. In a preferred embodiment, the stem is formed of a low friction nylon material to facilitate its axial and rotational movement with the central apertures of the plate member and sealing member.

Modern poptop carbonated beverage cans have a tab which is retained on the can after the can is open. It is contemplated that the can sealer of the present invention may be used with such cans by bending the tap back and forth a few times to break the tab from the can lid, leaving only a small portion of the tab attached. The deformability of the sealing member is such that it will readily conform to such minor irregularities in the surface of the can lid when it is compressed by the skirt portion of the plate member when the crosspiece is engaged and clamped in position.

To further insure the correct placement of the crosspiece within the opening of the can lid and the placement of the sealing member about the opening, the flange of the plate member is adapted to fit over the lip of the can rim 48, which also increases the stability of the can sealer in position, should the can be dropped or jarred, which might otherwise partially dislodge the can sealer.

In the foregoing description, it has been demonstrated that the post member of the can sealer facilitates the insertion of the crosspiece member within the opening of a can, and that the extension of the sealing member beyond the skirt of the plate member allows for a large, effective sealing surface. The flange of the member further provides for stability and accurate positioning of the can sealer. It should be appreciated that the arrangement of the handle at the end of the stem for urging the crosspiece towards the sealing member and plate member underneath the undersurface of the can lid could be replaced with another means for moving the stem member upwardly, such as a wing nut which might be tightened down over a threaded portion of the stem. Other means may also be appropriate for tightening the sealing member against the can lid surface in this fashion.

Although one specific embodiment of the invention has been described and illustrated, it is clear that it is susceptible to numerous modification and embodiments within the ability of those skilled in the art and without the exercise of the inventive faulty. Thus, it should be understood that various changes in form, detail and application of the present invention may be made without departing from the spirit and scope of this invention.

I claim:

1. A can sealer apparatus for sealing an opening in a generally flat can lid, comprising:

a plate member having a top side and bottom side, a skirt of a size sufficient to encompass the opening of the can lid protruding from the bottom side of the plate member and adapted to generally conform to the top surface of the can lid, the plate member having a surface defining a central opening in the plate member, and a post member protruding from the bottom surface of the plate member, the post member having at least one bottom bevelled edge;

b an elastomeric sealing member of a size sufficient to cover the opening in the can lid, and extending beyond the skirt of the plate member, the sealing member having a top side and a bottom side, the surface of the sealing member defining a central aperture adapted to be aligned with said plate member central aperture, and a secondary aperture adapted to receive the post member; and (c) handle means for urging the plate member and sealing member against the top surface of the can lid, said handle means including a stem adapted to extend through the central aperture of the plate member and the central aperture of the sealing member, a crosspiece member on one end of the stem adapted to ride over the bevelled edge of the post member in a first position, an adapted to engage the undersurface of the can lid in a second position, and the other end of the stem including means for moving the crosspiece between the crosspiece first and second positions, the means for moving having a first position in which the crosspiece may move freely to ride over the post member, and a second position urging the crosspiece member toward the plate member and sealing member, whereby the plate member and sealing member can be securely clamped to the can lid to seal the opening.

2. The can sealer apparatus of claim 1, wherein said plate member further includes a flange member depending downwardly from an edge of the plate member, adapted to fit over an outside lip of the can lid.

3. The can sealer apparatus of claim 1, wherein said post member has a plurality of bevelled corners on the bottom surface of said post member.

4. The can sealer apparatus of claim 1, wherein said means for urging said crosspiece towards said sealing member and plate member includes a handle at the end of said stem opposite said crosspiece, journaled for rotational movement about said stem end.

* * * * *